US010850301B2

(12) United States Patent
Kenney

(10) Patent No.: US 10,850,301 B2
(45) Date of Patent: Dec. 1, 2020

(54) CAULK SMOOTHING DEVICE

(71) Applicant: John A. Kenney, Oklahoma City, OK (US)

(72) Inventor: John A. Kenney, Oklahoma City, OK (US)

( * ) Notice: Subject to any disclaimer, the term of this patent is extended or adjusted under 35 U.S.C. 154(b) by 57 days.

(21) Appl. No.: 16/251,959

(22) Filed: Jan. 18, 2019

(65) Prior Publication Data

US 2019/0217329 A1 Jul. 18, 2019

Related U.S. Application Data

(60) Provisional application No. 62/618,905, filed on Jan. 18, 2018.

(51) Int. Cl.

| | |
|---|---|
| ***B05C 11/00*** | (2006.01) |
| ***B05C 17/005*** | (2006.01) |
| ***E04F 21/165*** | (2006.01) |
| ***B05C 17/10*** | (2006.01) |

(52) U.S. Cl.

CPC ..... *B05C 17/00516* (2013.01); *B05C 17/10* (2013.01); *E04F 21/1652* (2013.01); *E04F 21/1655* (2013.01)

(58) Field of Classification Search

CPC ..... B05C 17/00516; B05C 17/10; E04F 21/1652; E04F 21/1655

USPC ..... 401/136, 183, 266

See application file for complete search history.

(56) References Cited

U.S. PATENT DOCUMENTS

| | | | | |
|---|---|---|---|---|
| 5,588,560 | A * | 12/1996 | Benedict | B65D 35/38 222/106 |
| 6,767,151 | B1 * | 7/2004 | Owens | B05C 17/002 401/262 |
| 7,465,118 | B2 * | 12/2008 | Liberatore | B05C 17/00506 222/566 |
| 8,177,451 | B2 * | 5/2012 | Park | A46B 3/04 401/193 |
| 8,662,779 | B2 * | 3/2014 | deVirag | B65D 83/0011 401/132 |
| 9,259,757 | B1 * | 2/2016 | Santarsiero | B05C 17/10 |
| 2010/0278958 | A1 * | 11/2010 | Chamberlain | E04F 21/165 425/458 |

* cited by examiner

*Primary Examiner* — Jennifer C Chiang
(74) *Attorney, Agent, or Firm* — McAfee & Taft

(57) ABSTRACT

A caulk smoothing device is provided for wetting and smoothing caulk after application. The caulk smoothing device comprises a body, an inlet port, and an outlet port. The body has an outer surface with a first portion having a tapered end suitable for contacting and smoothing caulk. The tapered end may include a smoothing tip designed to match the surface to which the caulk is applied. The body defines a chamber configured to be a reservoir to hold fluid. An inlet port is defined by the body which allows fluid to be introduced into the reservoir. The body further defines an outlet port in fluid flow communication between the reservoir and the first portion of the outer surface of the body.

16 Claims, 6 Drawing Sheets

CAULK SMOOTHING DEVICE

CROSS-REFERENCE TO RELATED APPLICATION

This application claims the benefit of U.S. Provisional Application No. 62/618,905 filed Jan. 18, 2018, which is incorporated herein by reference.

TECHNICAL FIELD

The present disclosure relates generally to devices for applying sealants, such as caulk, and, more particularly, to devices configured to smooth such sealants.

BACKGROUND

In various fields of construction, there is a need to seal joints for the purposes of weatherproofing, water penetration, and preventing air leaks. Common practice is to seal joints with caulking or sealing material (hereinafter referred to as, "caulk") which can be comprised of different compounds. These different compounds include water based compounds, oil based compounds, and silicone based compounds. For example, the compounds can be rubber, polyurethane, silicone, and latex.

In most instances, the caulk is used to seal two unlike materials at right angle joints. To properly seal the joint, a caulk gun is used to pipe a bead of caulk at the joint. To finish the seal, a caulk finishing tool is used to press a bead of caulk into the joint. The caulk finishing tool also removes excess caulk and provides for a smooth finish, which is desirable for aesthetic purposes. However, caulk is consistently applied by inexperienced persons who do not get a smooth, precise appearing application. In addition, some caulk is made of a compound with a consistency that requires smoothing even when applied by professionals in order to get a smooth, precise appearance.

Typical caulk finishing tools in the most general form fit in one's hand and have a smooth, pointed edge at one end. The typical smooth, pointed edge of the caulk finishing tools helps to provide for a smooth caulk bead finish. If a user does not have a caulk finishing tool, they can also run a finger along the joint where the bead of caulk has been applied to achieve a smooth surface. However, this does not always result in the smooth, aesthetically pleasing appearance typically desired.

To properly smooth the caulk, it can be expedient, or necessary, to place a small amount of a lubricant of a type compatible with the caulk, such as a liquid thinner, directly on the bead of caulk before or as a smoothing effort is made. This typically entails wetting the tip of the caulk finishing tool or the finger with the appropriate lubricant for the caulk, or it can entail dispensing or spraying the lubricant on the caulk bead after it is applied. This process can be cumbersome and time consuming to the user as they continuously have to wet the caulk while trying to use the caulk finishing tool. These deficiencies prompt the need for a way to easily apply lubricant to the bead of caulk as the caulk finishing tool or finger is moved along the caulk surface. This disclosure provides for such need.

SUMMARY

In accordance with the present invention, an apparatus for smoothing caulk is provided which overcomes the deficiencies described above, and has other advantages.

In one embodiment, a caulk smoothing device is provided. The caulk smoothing device comprises a body, an inlet port, and an outlet port. The body has an outer surface with a first portion having a tapered end configured to contact and smooth caulk. The body defines a chamber configured to be a reservoir to hold fluid. An inlet port is defined by the body and allows fluid to be introduced into the reservoir. An outlet port is defined by the body and is in fluid flow communication between the reservoir and the first portion of the outer surface of the body.

In addition to or in the alternative to the previous embodiment, the body of the caulk smoothing device may have a resilient portion that at least partially surrounds the reservoir. The resilient portion has a neutral position and a dispensing position. The dispensing position allows fluid to be released from the reservoir through the outlet portion. The application of pressure on the resilient portion causes movement from the neutral position to the dispensing position.

According to another embodiment, the caulk smoothing device comprises a body, an inlet port, an outlet port, a nozzle, an absorbent material, and a valve. The body has a resilient portion that at least partially surrounds the reservoir. The resilient portion has a neutral position and a dispensing position. The dispensing position allows fluid to be released from the reservoir through the outlet portion. The application of pressure on the resilient portion causes movement from the neutral position to the dispensing position. The body has an outer surface with a first portion configured to contact and smooth caulk. The first portion of the outer surface has a convex contour and a tapered end. The tapered end has a concave recess opposing at least a portion of the first portion of the outer surface. The tapered end has a smoothing tip designed to match the surface to which the caulk is applied.

The body defines a chamber which is configured to be a reservoir to hold fluid. An inlet port is defined by the body and allows fluid to be introduced into the reservoir. An outlet port is defined by the body and is in fluid flow communication between the reservoir and the first portion of the outer surface of the body. The outlet port is located in a way such that, when the caulk smoothing device is used to smooth caulk, fluid contacts the caulk before the tapered end.

The nozzle is recessed within the outer port and configured to create a spray of the fluid released through the outlet port. An absorbent material is recessed within the outlet portion and dispersed around the nozzle. The absorbent material is configured to absorb excess amounts of fluid that are released through the nozzle. The valve has an open position and a closed position. In the open position, the valve allows fluid to be released from the reservoir through the outlet port and, in the closed position, the valve retains fluid within the reservoir

BRIEF DESCRIPTION OF THE DRAWINGS

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

FIG. 15 is a cross-sectional view of the caulk smoothing device of FIG. 14 in accordance with this disclosure.

DETAILED DESCRIPTION

Figure 1:
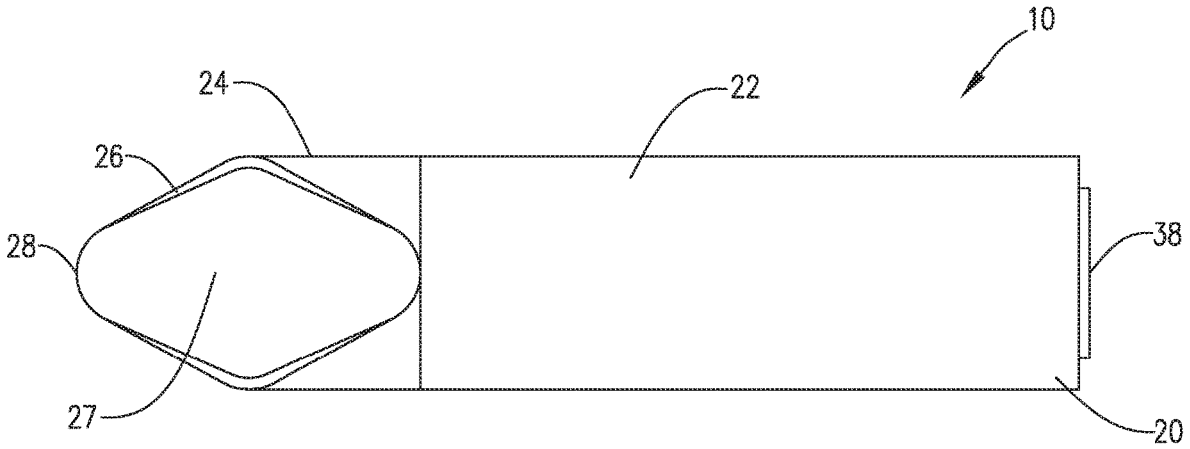
FIG. 1 is a top view of a caulk smoothing device in accordance with one embodiment of the present disclosure.
Figure 2:
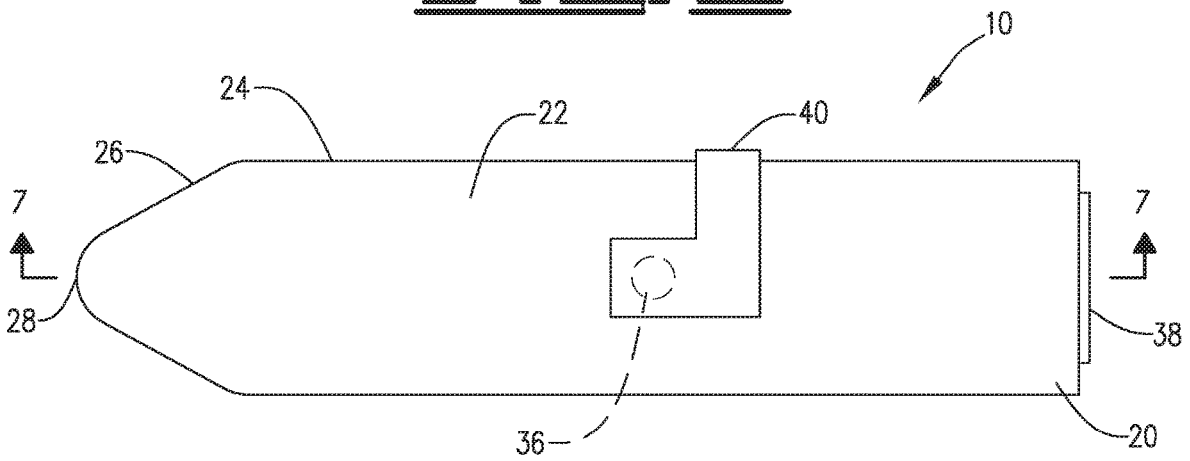
FIG. 2 is a bottom view of a caulk smoothing device with the valve in the closed position in accordance with one embodiment of the present disclosure.
Figure 3:
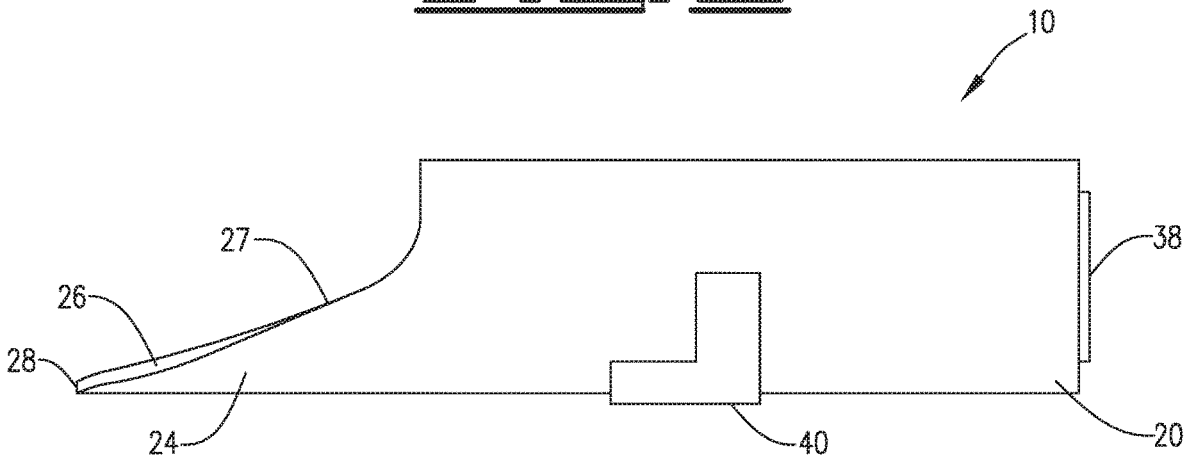
FIG. 3 is a side view of a caulk smoothing device with the valve in the closed position in accordance with one embodiment of the present disclosure.
Figure 4:
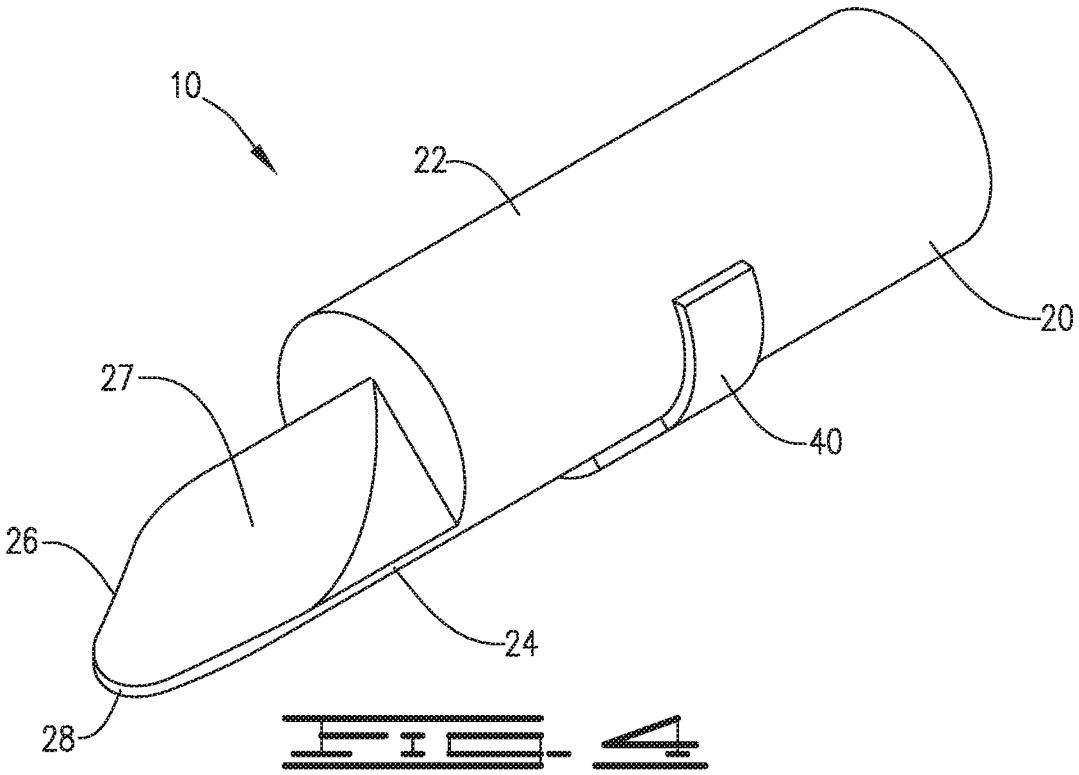
FIG. 4 is perspective top view of a caulk smoothing device with the valve in the closed position in accordance with one embodiment of the present disclosure.
Figure 5:
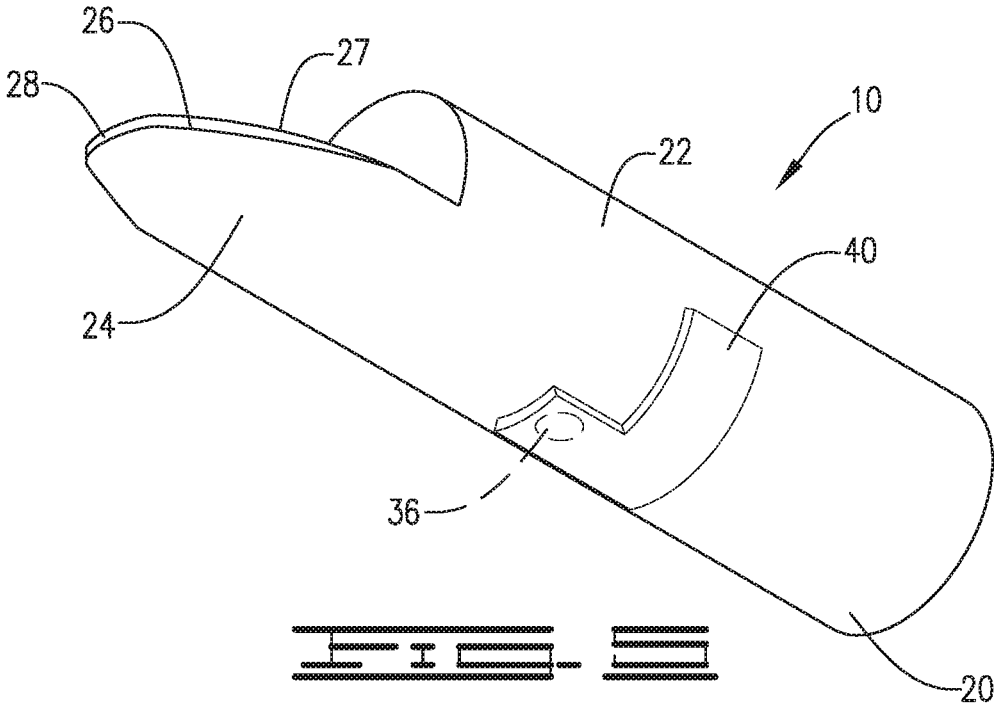
FIG. 5 is a perspective bottom view of a caulk smoothing device with the valve in the closed position in accordance with one embodiment of the present disclosure.

The present disclosure may be understood more readily by reference to these detailed descriptions. For simplicity and clarity of illustration, where appropriate, reference numerals may be repeated among the different figures to indicate corresponding or analogous elements. In addition, numerous specific details are set forth in order to provide a thorough understanding of the various embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Referring now to FIGS. 1-17 generally, the caulk smoothing device of the present disclosure is illustrated and generally designated by the numeral 10. As most easily seen from FIGS. 1 and 7, caulk smoothing device 10 comprises a body 20, which defines a chamber or reservoir 30 configured to hold a fluid 32. Body 20 has an outer surface 22 with a first portion 24 configured to contact and smooth caulk. In some embodiments, first portion 24 of outer surface 22 may be convex such that first portion 24 has a convex contour. The convex contour provides a rounded finish to the joints to which caulk is applied. In these and other embodiments, first portion 24 may include a tapered end 26. Tapered end 26 allows for a more precise interaction with the joints to which caulk is applied. It is to be understood that tapered end 26 may be tapered width wise or thickness wise depending on the relevant application.

In one embodiment, tapered end 26 may have a concave recess 27 that opposes at least a portion of first portion 24 of outer surface 22. Concave recess 27 allows a finger to comfortably fit on and control caulk smoothing device 10. In some embodiments, tapered end 26 may have a smoothing tip 28. It is to be understood that, although in most applications, tapered end 26 can be sufficient to adequately smooth caulk on a surface, in some applications it can be helpful to include smoothing tip 28 that can be designed to match the surface to which the caulk is applied. Matching the surface to which the caulk is applied helps to ensure caulk smoothing device 10 can glide smoothly across the surface and penetrate the joint being caulked. For example, smoothing tip 28 may be right-angle shaped such that smoothing tip 28 fits precisely within right angle joints. Smoothing tip 28 may also be of a straight edge design such that smoothing tip 28 may glide across and smooth the caulk applied between two flat tiles.

In additional embodiments, as specifically illustrated in FIGS. 8-11, body 20 may terminate with a flat edge 21. Flat edge 21 of body 20 allows caulk smoothing device 10 to fit comfortably in the palm of a person's hand such that the person can use his or her finger as the means for smoothing the applied caulk while still utilizing the benefits of caulk smoothing device 10. Some users prefer the use of a finger as the smoothing tip as it gives a more rounded finish.

Reservoir 30 is configured to hold fluid 32. Fluid 32 can be any fluid that is suitable with the particular caulk being used for a job. For example, if a water-based caulk is used, fluid 32 need only be water. If an oil-based caulk is used, fluid 32 may be an oil-based thinner. It will be readily apparent to those skilled in the art that it is advantageous to match fluid 32 with the base of the caulk used for the job.

In some embodiments, reservoir 30 may be removable and replaceable. For example, once fluid 32 within reservoir 30 runs out, reservoir 30 may be removed from within body 20 and replaced with another reservoir 30 that is pre-filled with a particular fluid 32. Such embodiments allow for quick and easy refills of reservoir 30 without leaving the caulking area, as a person may have refills in his or her pockets. For example, reservoir 30 can be a plastic bag which may be inserted into body 20. In some cases, the interior of body 20 may include a spike or needle to puncture the bag to create fluid flow communication with outlet port 36, which is further described below.

As most easily seen from FIGS. 7, 10, 15 and 17, body 20 defines an inlet port 34 and an outlet port 36. Inlet port 34 and outlet port 36 provide fluid flow communication between outer surface 22 and reservoir 30. Fluid flow communication between outer surface 22 and reservoir 30 allows fluid 32 to be introduced into reservoir 30 through inlet port 34 and allows reservoir 30 to release fluid 32 through outlet port 36. Caulk smoothing device 10 may include a cap 38 that is configured to seal inlet port 34. In some embodiments, cap 38 permanently seals inlet port 34 such that once fluid 32 within reservoir 30 runs out, reservoir 30 can never be refilled. In other embodiments, cap 38 is removable and replaceable such that cap 38 can be removed to fill reservoir 30 with fluid 32 and then can be put back into place to seal inlet port 34 to retain fluid 32 within reservoir 30. Such embodiments allow for caulk smoothing device 10 to be used on multiple occasions and allow caulk smoothing device 10 to use differing fluids 32 within reservoir 30.

Turning now to FIGS. 1-11, outlet port 36 may be positioned on the bottom of caulk smoothing device 10 such that when a person holds caulk smoothing device 10 in his or her hand, or on his or her finger, outlet port 36 is on the side of caulk smoothing device 10 opposite the person's hand or finger. In other embodiments, as illustrated in FIGS. 12-17, outlet port 36 may be positioned on the bottom of first portion 24 and tapered end 26. In such embodiments, a fluid flow passage 33 provides fluid flow communication between reservoir 30 and outlet port 36. In additional embodiments, outlet port 36 may be positioned in a way such that, when caulk smoothing device 10 is used to smooth caulk, fluid 32 contacts the caulk before tapered end 26. Depending on the angle by which caulk smoothing device 10 is used, it may be more or less desirable to position outlet port 36 closer to the end of tapered end 26.

Figure 6:
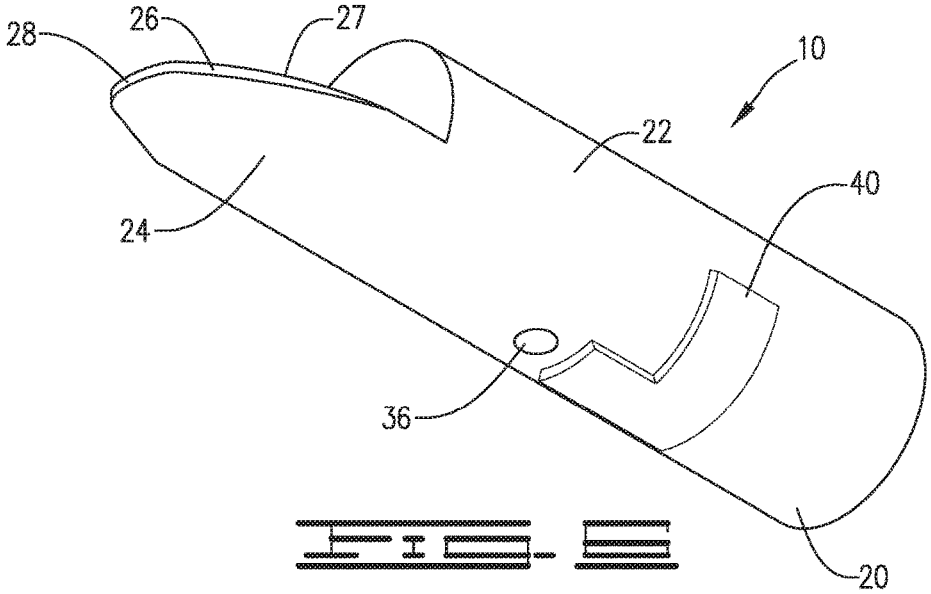
FIG. 6 is a perspective bottom view of a caulk smoothing device with the valve in the open position in accordance with one embodiment of the present disclosure.
Figure 7:
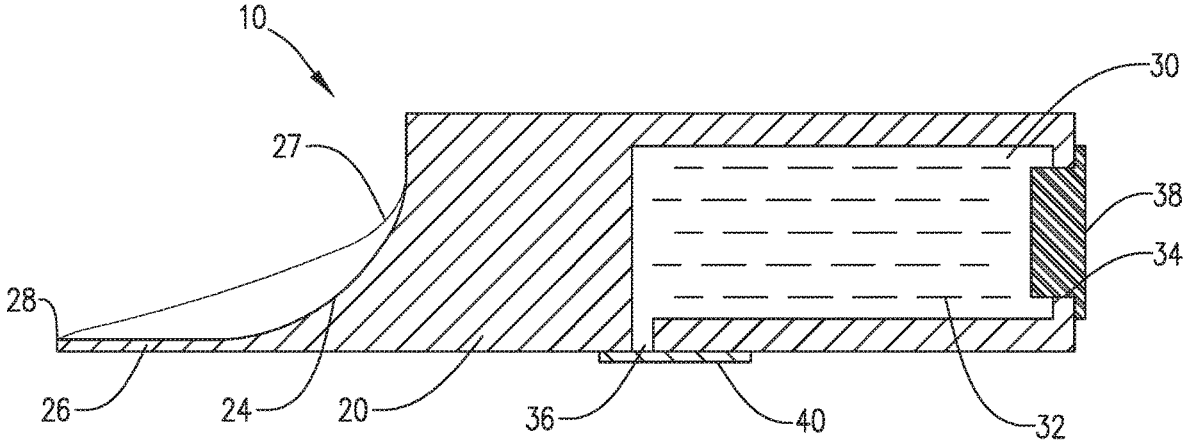
FIG. 7 is a cross-sectional view of the caulk smoothing device of FIG. 2 in accordance with this disclosure.
Figure 8:
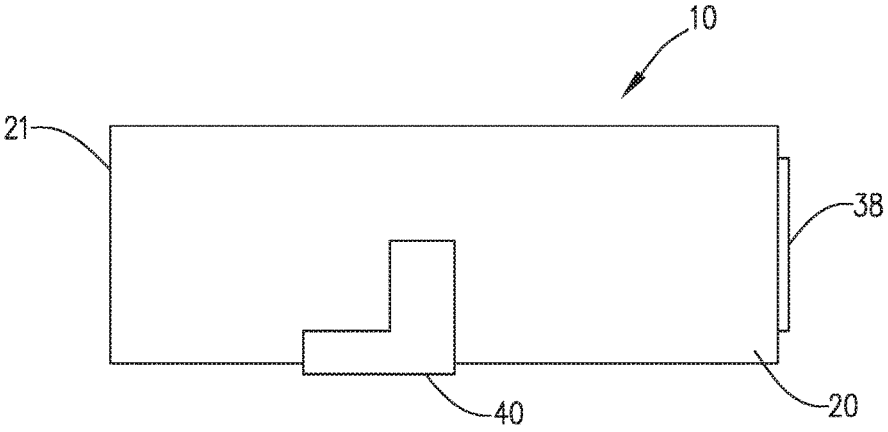
FIG. 8 is a side view of an alternative embodiment of a caulk smoothing device in accordance with one embodiment of the present disclosure.
Figure 9:
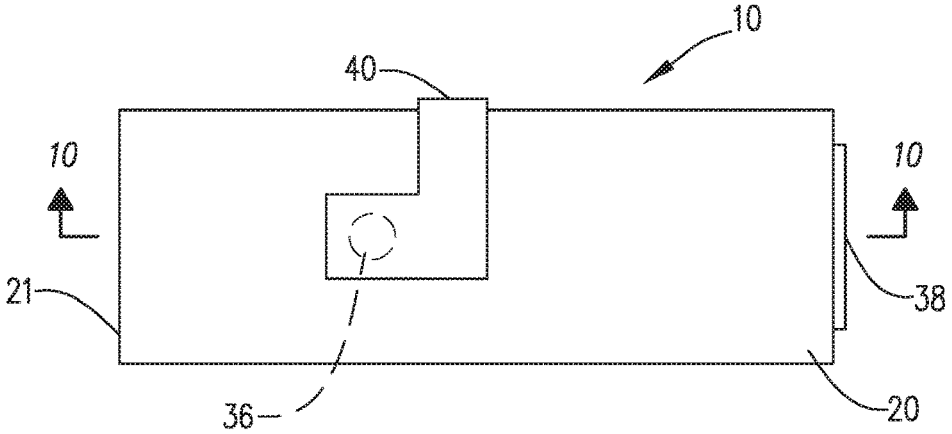
FIG. 9 is a bottom view of an alternative embodiment of a caulk smoothing device in accordance with one embodiment of the present disclosure.
Figure 10:
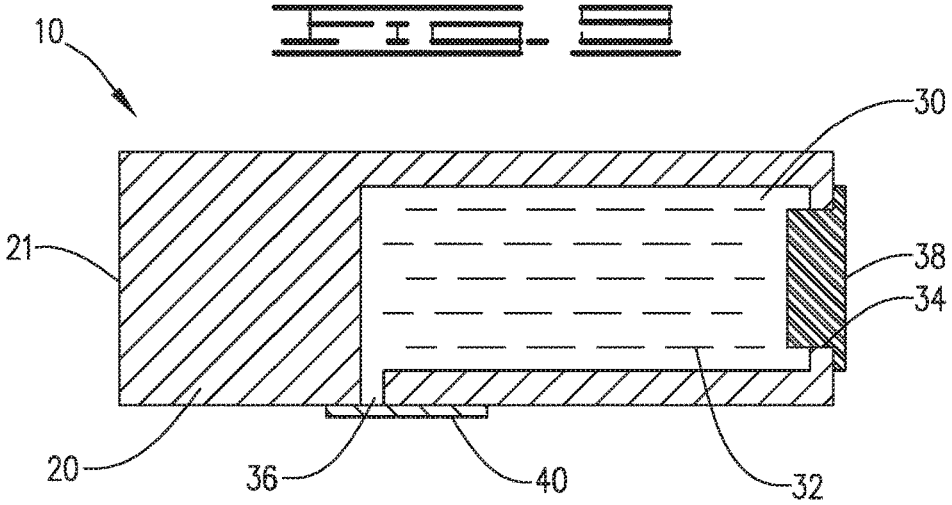
FIG. 10 is a cross-sectional view of the caulk smoothing device of FIG. 9 in accordance with this disclosure.
Figure 11:
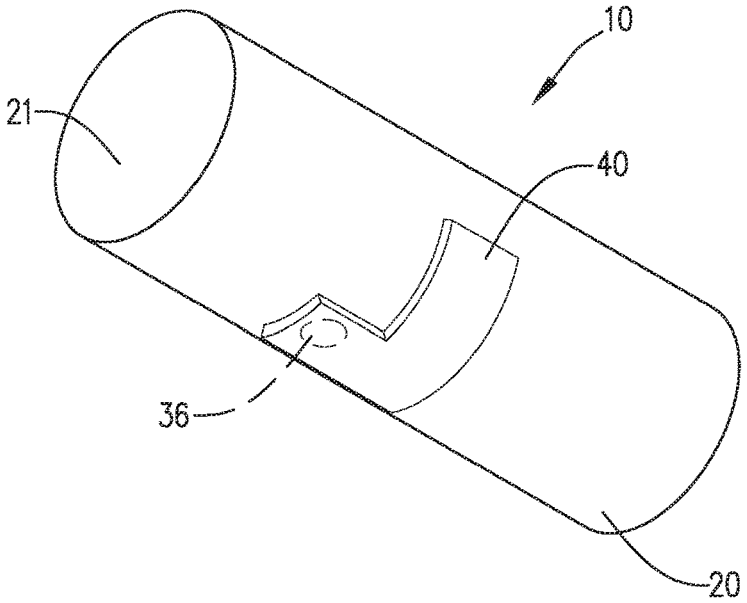
FIG. 11 is a bottom perspective view of an alternative embodiment of a caulk smoothing device in accordance with one embodiment of the present disclosure.
Figure 12:
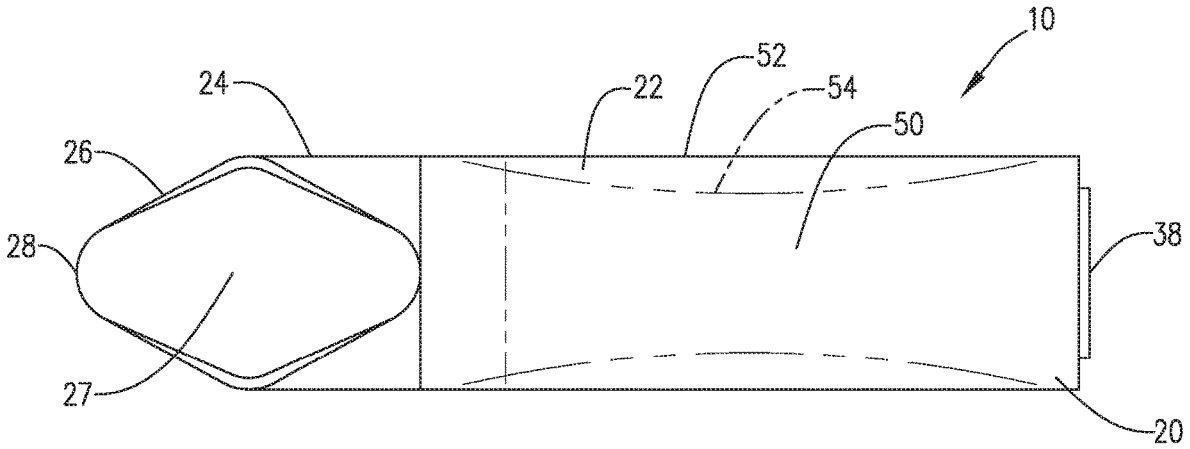
FIG. 12 is a top view of a caulk smoothing device having a resilient body in accordance with one embodiment of the present disclosure.

In some embodiments, such as illustrated in FIGS. 1-11, caulk smoothing device 10 may include a valve 40. Valve 40 has an open position and a closed position. FIG. 6 illustrates valve 40 in the open position. The open position of valve 40 allows fluid 32 to be released from reservoir 30 through outlet port 36. FIGS. 2-5 and 7-11 illustrate valve 40 in the closed position. In the closed position, valve 40 retains fluid 32 within reservoir 30. In some embodiments, valve 40 extends up from the bottom of body 20 such that a person can open and close valve 40 with the use of their thumb. Such embodiments of valve 40 allow for caulk smoothing device 10 to be fitted for righties and lefties. For lefties, valve 40 can extend up to the right side of body 20. For righties, valve 40 can extend up to the left side of body 20. In some embodiments, valve 40 may have a button on the side of body 20. In such embodiments, when the button (not shown) is pushed in, outlet port 36 releases fluid 32 from reservoir 30, and when the button is released, outlet port 36 retains fluid 32 within reservoir 30. In such embodiments, the button can be fitted for righties and lefties. For lefties, the button can be on the right side of body 20. For righties, the button can be on the left side of body 20.

In additional embodiments, caulk smoothing device 10 may release fluid 32 from reservoir 30 with simple pressure. For example, in some embodiments, when pressure is applied to smoothing tip 28, outlet port 36 may open such that fluid 32 is released from reservoir 30. In such embodiments, the more pressure applied to smoothing tip 28, the more fluid 32 that is released from reservoir 30 through outlet port 36. In other embodiments, the application of pressure on body 20 may cause fluid 32 to be released through outlet port 36.

Turning now to FIGS. 12-17, body 20 may have a resilient portion 50 at least partially surrounding reservoir 30. Resilient portion 50 allows fluid 32 to be released from reservoir 30 through outlet port 36 with the application of pressure on resilient portion 50. Resilient portion 50 is resilient so as to be compressible inwards under pressure and return to its decompressed state when the pressure is released. Thus, resilient portion 50 has a neutral position, depicted by the lines associated with reference numeral 52, and a dispensing position, depicted by the lines associated with reference numeral 54. Dispensing position 54 causes fluid 32 to be released from reservoir 30 through outlet port 36. Application of pressure on resilient portion 50 causes movement between neutral position 52 and dispensing position 54.

As further shown in FIGS. 12-17, caulk smoothing device 10 may further comprise an absorbent material 60 recessed within outlet port 36. Absorbent material 60 is in fluid flow communication with fluid 32 in outlet port 36. In some embodiments, absorbent material 60 may be a sponge. Absorbent material 60 creates a barrier to prevent fluid 32 from spilling out of reservoir 30 through outlet port 36. Upon application of a certain amount of pressure on resilient portion 50, resilient portion 50 will move from neutral position 52 to dispensing position 54 such that fluid 32 in absorbent material 60 will be released through outlet port 36.

Figure 13:
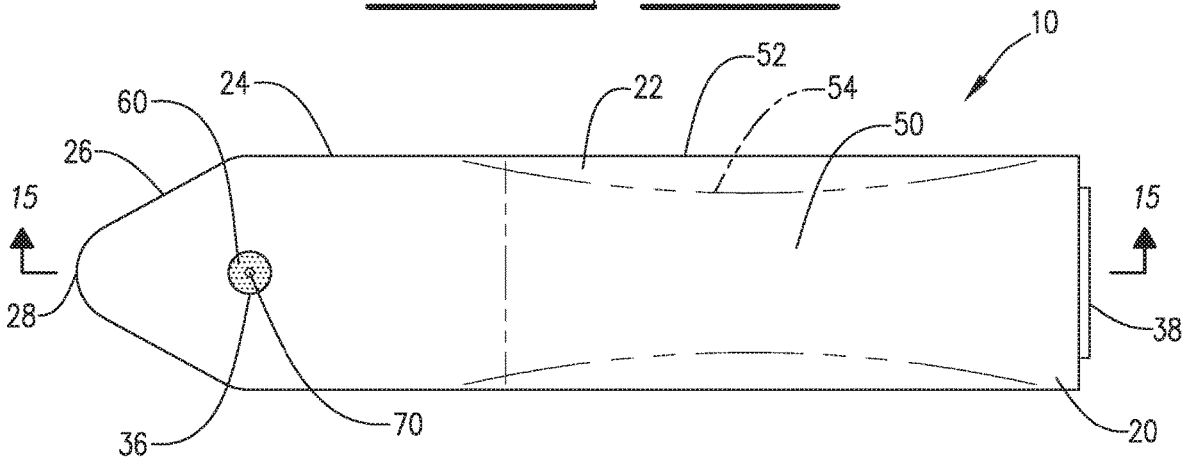
FIG. 13 is a bottom view of a caulk smoothing device having a resilient body in accordance with one embodiment of the present disclosure.
Figure 14:
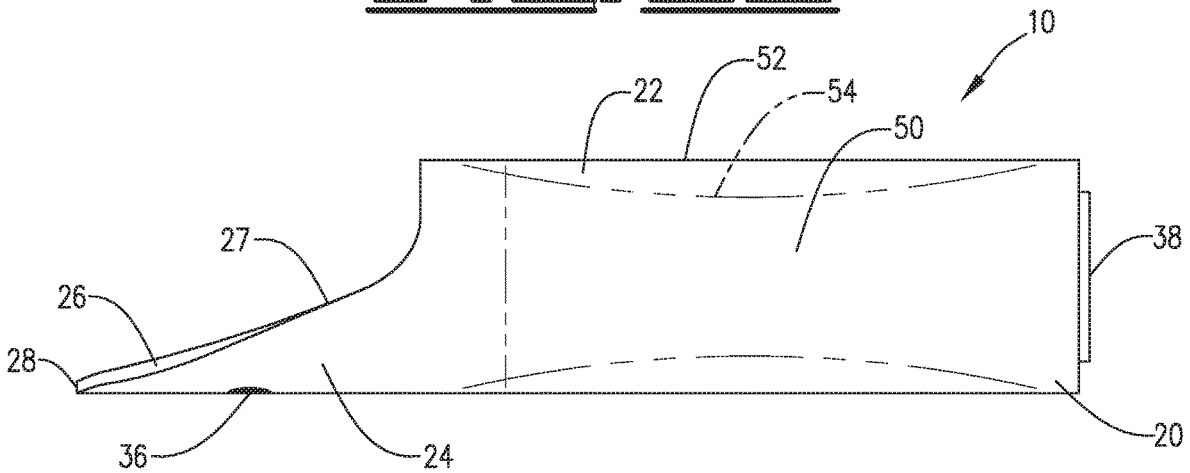
FIG. 14 is a side view of a caulk smoothing device having a resilient body in accordance with one embodiment of the present disclosure.
Figure 16:
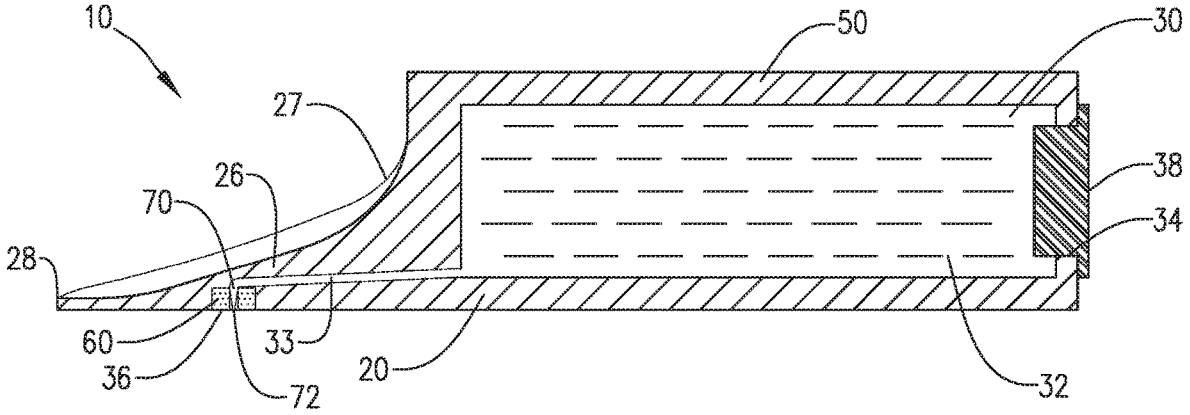
FIG. 16 is a perspective bottom view of a caulk smoothing device in accordance with one embodiment of the present disclosure.
Figure 18:
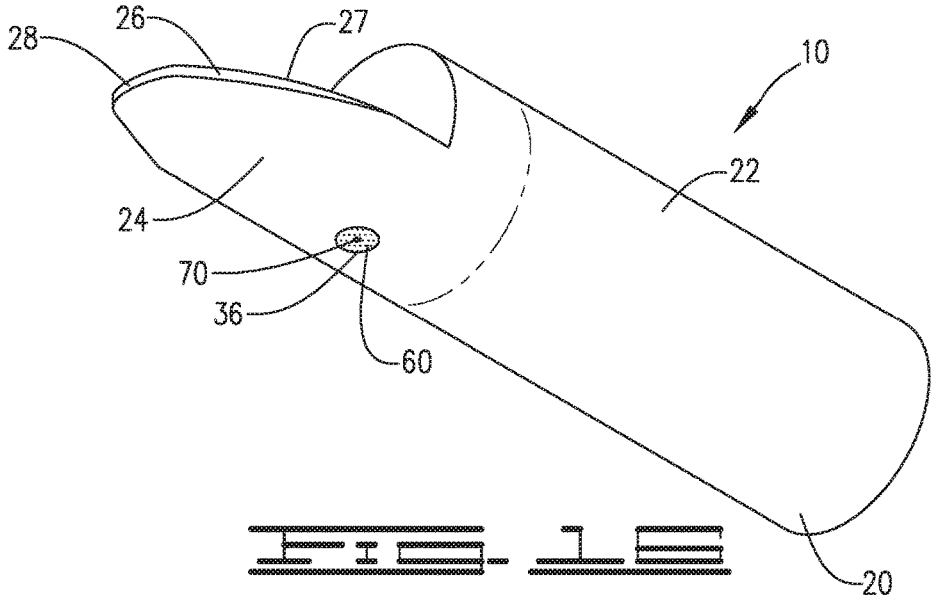
Figure 17:
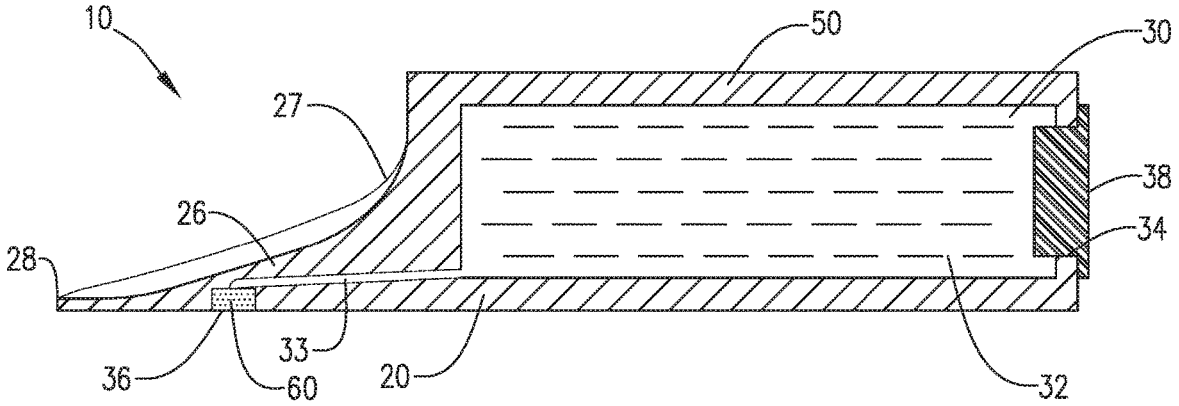
FIG. 17 is a cross-sectional view of the caulk smoothing device in accordance with another embodiment of this disclosure.

In some embodiments, as illustrated in FIGS. 13 and 15-16, caulk smoothing device 10 may include a nozzle 70 recessed within outlet port 36. Nozzle 70 is configured to create a spray of the fluid 32 released through outlet port 36. In embodiments such as illustrated in FIG. 15, nozzle 70 may have a tapered tip 72. Tapered tip 72 allows for a more precise, pressurized stream of fluid 32 to be released through outlet port 36. Nozzle 70 may be adjustable so as to vary the flow rate of fluid 32 released from reservoir 30 through outlet port 36. Certain jobs may require more or less fluid 32 to be released. The adjustability of nozzle 70 allows for this need to be addressed. As illustrated in FIGS. 13, 15 and 16, absorbent material 60 may be recessed within outlet port 36 and dispersed around nozzle 70. Such embodiments allow absorbent material 60 to absorb excess amounts of fluid 32 that are released through nozzle 70 which prevents unwanted dripping on the caulk being smoothed.

In some embodiments (not illustrated), caulk smoothing device 10 is equipped with a means to attach caulk smoothing device 10 to a person's finger and/or hand. For example, in some embodiments, a hollow ring may extend from the top of body 20 such that a person can slide his or her finger through the hollow ring. In other embodiments, caulk smoothing device 10 may include an adjustable strap extending from body 20 such that a person can pull the strap over his or her hand and adjust the strap such that caulk smoothing device 10 is secured to the person's hand. In additional embodiments, caulk smoothing device 10 may include an adjustable strap extending from body 20 such that a person can pull the strap over his or her finger and adjust the strap such that caulk smoothing device 10 is secured to the person's finger. In other embodiments, caulk smoothing device 10 may be equipped with a resilient strap extending from body 20. In such embodiments, a person can extend either his or her finger or hand under the resilient strap to secure caulk smoothing device 10.

In operation, in accordance with one embodiment of the present disclosure, a person would first put down a bead of caulk to fill a joint on a job site. For purposes of this example, a bead of water-based caulk has been put down to fill the joint between a kitchen backsplash and the granite countertop. Next, the person would take caulk smoothing device 10 and remove cap 38 from inlet port 34. The person would then fill reservoir 30 with a fluid 32, water in this example, and then reseal inlet port 34 with cap 38. Next, smoothing tip 28 of tapered end 26 would be placed on the joint to be smoothed and the person would slowly start sliding smoothing tip 28 across the joint. As the person slides smoothing tip 28 across the joint, the person would slide valve 40 into the open position such that water 32 is released from reservoir 30 through outlet port 36. This would saturate the caulk such that a smooth, precise finish is achieved with smoothing tip 28. If reservoir 30 runs outs of water 32 prior to completing the job, the person can simply remove cap 38 from inlet port 34, refill reservoir 30 with water 32, reseal inlet port 34 with cap 38, and continue smoothing the caulk. Once the job is complete, the person can either throw caulk smoothing device 10 away or can remove cap 38 from inlet port 34, empty the remaining water 32 out of reservoir 30, reseal inlet port 34 with cap 38, and store caulk smoothing device 10 until the next job.

Although certain preferred embodiments of the invention have been herein described in order to illustrate the principles of the invention, it will be understood that various changes and innovations in structure can be effected without departure from these principles. Changes and innovations of this type are therefore deemed to be circumscribed by the spirit and scope of the invention except as the same may be limited by the appended claims or reasonable equivalents thereof.

What is claimed is:

1. A caulk smoothing device comprising:

a body having an outer surface with a first portion configured to contact and smooth caulk, the first portion of the outer surface having a tapered end, and wherein the body defines a chamber which is configured to be a reservoir to hold fluid;

an inlet port defined by the body, the inlet port allowing fluid to be introduced into the reservoir; and an outlet port defined by the body, the outlet port in fluid flow communication between the reservoir and the first portion of the outer surface of the body, wherein the outlet port is located in a way such that, when the caulk smoothing device is used to smooth caulk, fluid contacts the caulk before the tapered end.

2. The caulk smoothing device of claim 1, wherein the first portion of the outer surface is convex so as to form a convex contour.

3. The caulk smoothing device of claim 1, wherein the tapered end has a concave recess opposing at least a portion of the first portion of the outer surface.

4. The caulk smoothing device of claim 1, the tapered end further comprising a smoothing tip, wherein the smoothing tip is designed to match a surface to which the caulk is applied.

5. The caulk smoothing device of claim 1, further comprising a cap configured to seal the inlet port of the body.

6. The caulk smoothing device of claim 1, further comprising a valve having an open position and a closed position, wherein in the open position the valve allows fluid to be released from the reservoir through the outlet port and in the closed position the valve retains fluid within the reservoir.

7. The caulk smoothing device of claim 1, wherein the body has a resilient portion at least partially surrounding the reservoir.

8. The caulk smoothing device of claim 7, wherein the resilient portion is resilient so as to have a neutral position and a dispensing position, the dispensing position configured to cause fluid to be released from the reservoir through the outlet port, and wherein the application of pressure on the resilient portion causes movement from the neutral position to the dispensing position.

9. The caulk smoothing device of claim 1, further comprising an absorbent material recessed within the outlet port, the absorbent material in fluid flow communication with fluid in the outlet port.

10. The caulk smoothing device of claim 9, wherein the absorbent material is a sponge.

11. The caulk smoothing device of claim 1, wherein the reservoir is configured to release fluid from the reservoir through the outlet port upon the application of pressure to the body.

12. The caulk smoothing device of claim 11, further comprising a nozzle recessed within the outlet port, wherein the nozzle is configured to create a spray of the fluid released through the outlet port.

13. The caulk smoothing device of claim 12, wherein the nozzle has a tapered tip.

14. The caulk smoothing device of claim 12, wherein the nozzle is adjustable so as to vary the flow rate of fluid released from the reservoir through the outlet port.

15. The caulk smoothing device of claim 12, further comprising an absorbent material recessed within the outlet port and dispersed around the nozzle, the absorbent material configured to absorb excess amounts of fluid that are released through the nozzle.

16. The caulk smoothing device of claim 14, further comprising:

a valve having an open position and a closed position, wherein in the open position the valve allows fluid to be released from the reservoir through the outlet port and in the closed position the valve retains fluid within the reservoir, and wherein:

the first portion of the outer surface is convex so as to form a convex contour;

the tapered end has a concave recess opposing at least a portion of the first portion of the outer surface;

the tapered end has a smoothing tip, the smoothing tip designed to match a surface to which the caulk is applied;

the outlet port is located in a way such that, when the caulk smoothing device is used to smooth caulk, fluid contacts the caulk before the smoothing tip;

the body has a resilient portion at least partially surrounding the reservoir; and the resilient portion is resilient so as to release fluid from the reservoir through the outlet port upon the application of pressure to the resilient portion, and wherein the resilient portion has a neutral position and a dispensing position, the dispensing position configured to cause fluid to be released from the reservoir through the outlet port, and wherein the application of pressure on the resilient portion causes movement from the neutral position to the dispensing position.

* * * * *